United States Patent [19]

Holmes

[11] 4,320,756

[45] Mar. 23, 1982

[54] FRESH-AIR BREATHING DEVICE AND METHOD

[76] Inventor: William O. Holmes, 1331 Old Country Rd., Belmont, Calif. 94402

[21] Appl. No.: 237,869

[22] Filed: Feb. 25, 1981

[51] Int. Cl.[3] ..... A62B 7/10; A62B 7/12

[52] U.S. Cl. ..... 128/206.12; 128/207.14; 128/207.12; 128/200.24

[58] Field of Search ..... 128/200.24, 201.11, 128/205.25, 205.12, 205.27, 205.28, 205.29, 206.12, 206.15, 206.21, 206.28, 207.12, 207.14

[56] References Cited

U.S. PATENT DOCUMENTS

| | | | |
|---|---|---|---|
| 276,699 | 5/1883 | McIntosh | 128/206.12 |
| 409,428 | 8/1889 | Richet | 128/206.12 |
| 1,007,644 | 10/1911 | Cocke | 128/207.12 |
| 1,423,923 | 7/1922 | Eckert, Jr. | 128/201.11 |
| 2,577,606 | 12/1951 | Conley | 128/205.29 |

FOREIGN PATENT DOCUMENTS

| | | | |
|---|---|---|---|
| 1473382 | 3/1967 | France | 128/201.11 |
| 949141 | 9/1956 | Fed. Rep. of Germany | 128/207.12 |

*Primary Examiner*—Henry J. Recla
*Attorney, Agent, or Firm*—Phillips, Moore, Weissenberger, Lempio & Majestic

[57] ABSTRACT

The recent rash of fires in high-rise hotels and deaths occasioned thereby has given rise to the need for a breathing device and method for supplying a hotel guest and/or fireman with fresh air until he can be rescued. The device and method of this invention provide for the insertion of a breathing tube through the water trap of a toilet to expose an open end thereof to fresh air from a vent pipe connected to a sewer line of the toilet, to enable the user to breathe fresh air through the tube.

4 Claims, 5 Drawing Figures

28
20
16
20
10
12
19
21
11
14
26
27
25
13
15

FIGURE 2
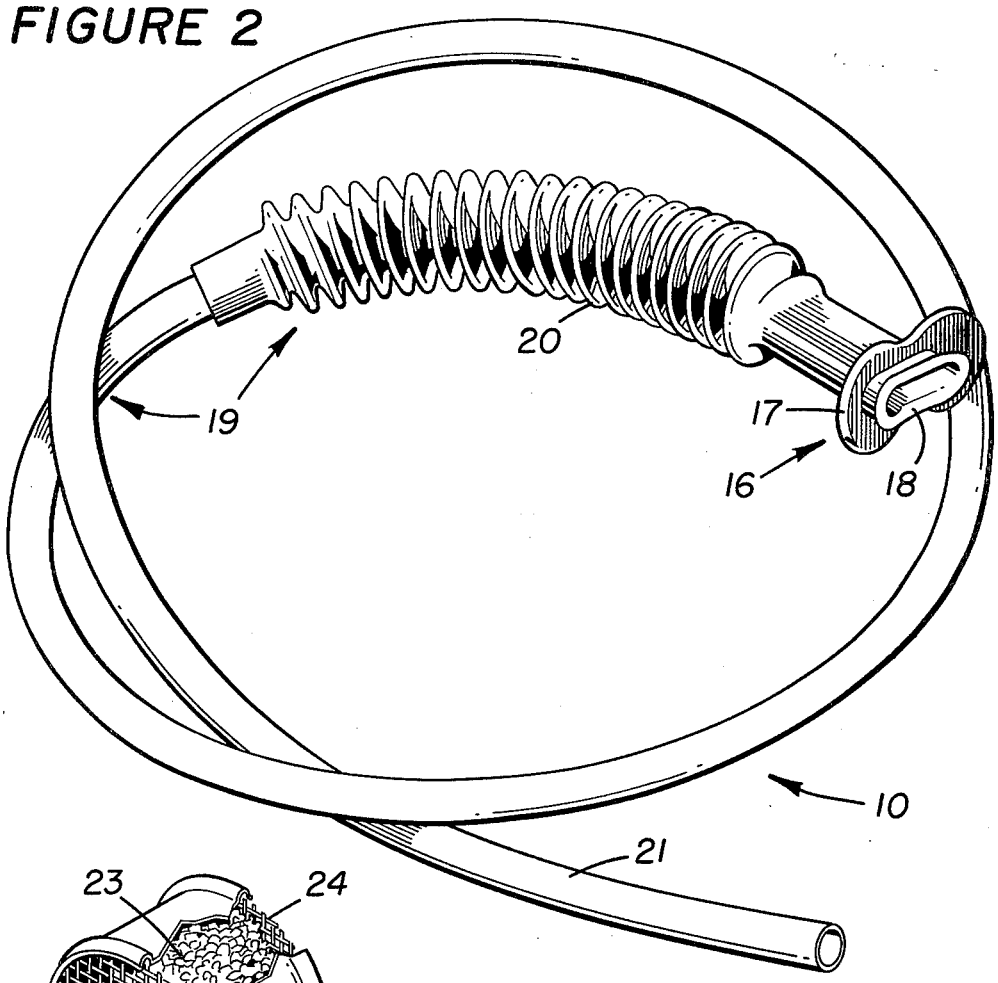
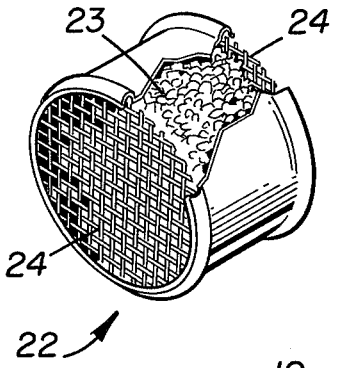
FIGURE 4
FIGURE 3
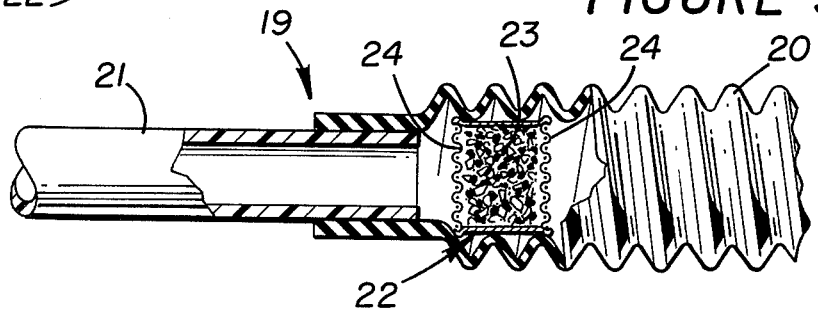

FRESH-AIR BREATHING DEVICE AND METHOD

DESCRIPTION

1. Technical Field

This invention relates generally to a device and method for breathing fresh air while entrapped in a room filled with toxic smoke, and more particularly to a breathing tube adapted to have an open end thereof inserted through a water-trap of a toilet to enable the user, exposed to toxic smoke inhalation, to breathe fresh air until he is rescued.

2. Background Art

The recent rash of fires in high-rise hotels has resulted in the death of numerous people due to toxic smoke inhalation. Although the various fire departments involved expedited recovery efforts to save such people from impending death, the various toxic gases intermixed with the smoke, resulting from the burning of plastic furniture materials and the like, proved lethal within a very short time period. It has thus proven critical to provide the entrapped hotel guest with a source of fresh air or oxygen until the guest is rescued. Furthermore, experience has shown that the entrapped guest should remain in his or her hotel room, rather than attempt to proceed to the roof or any other floor of the hotel, to facilitate the rescue operation.

A fireman, in performing firefighting and rescue operations of the above type, normally carries a canister of oxygen with him for breathing purposes. On occasion, the fireman will deplete his supply of oxygen to thus also subject himself to toxic smoke inhalation. Therefore, it would prove desirable to provide not only a hotel guest with a supply of fresh air, when needed, but to also provide such air to a fireman who may encounter the above type of emergency situation.

DISCLOSURE OF INVENTION

This invention provides an economical device and method for ensuring a life-saving supply of fresh air to a person entrapped in a burning hotel room or the like, when the person is subjected to toxic smoke inhalation.

The fresh-air breathing device comprises breathing means for being held in communication with a respiratory intake passage (mouth and/or nose) of the user and conduit means for communicating fresh air to such respiratory intake, including a first end connected to the breathing means and an open second end having sufficient flexibility and length for insertion through a water trap of a toilet. Carrying forth the method of this invention, such insertion of the conduit means or breathing tube through the water trap will expose the open end thereof to fresh air from a vent pipe connected to a sewer line of the toilet. The user may then proceed to breathe fresh air for life-saving purposes, until rescued.

BRIEF DESCRIPTION OF THE DRAWINGS

Other advantages and objects of this invention will become apparent from the following description and accompanying drawings wherein:

FIG. 2 is an isometric view of the fresh-air breathing device;

FIG. 3 is a sectional view, taken in the direction of arrows III—III in FIG. 2, illustrating an air filter that can be incorporated into the breathing device;

FIG. 4 is an isometric view of the air filter; and

BEST MODE OF CARRYING OUT THE INVENTION

Figures 1, 5:
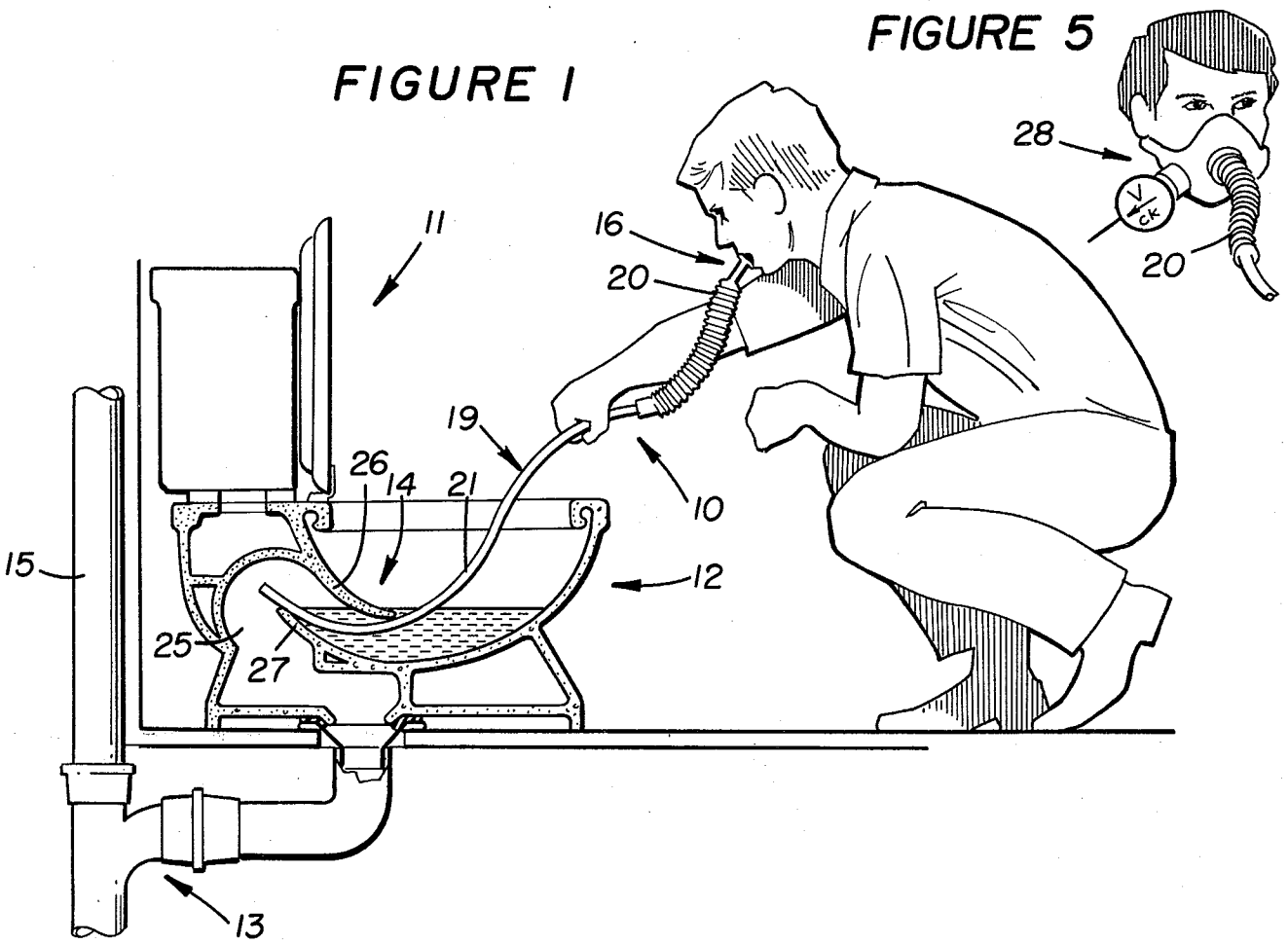
FIG. 1 illustrates a person utilizing the fresh-air breathing device of this invention for breathing fresh air through the water trap of a toilet.
FIG. 5 illustrates a modified breathing means for the air breathing device.

FIG. 1 illustrates a fresh-air breathing device embodiment 10 of the present invention, shown held by a user for the purpose of breathing fresh air in a room filled with toxic smoke, such as occurs during a hotel fire or the like. The device is used in association with a toilet 11 having a bowl or water closet 12 connected in a conventional manner to a sewer line or soil pipe 13 for draining waste materials and water upon flushing of the toilet. It is well known that upon flushing of the toilet, a water trap 14 will form in the toilet bowl to block sewer gases from entering into the bathroom proper. Conversely, the water trap functions to prevent toxic smoke in the bathroom from passing thereby.

It is common practice to attach a fresh-air vent 15 in the form of a pipe or stack to the sewer line to provide optimum operation of the toilet. The air vent normally extends upwardly through the roof of a structure, such as a high-rise hotel, to expose it to ambient fresh air, whereby suction-locking is avoided in the drain and water and waste are permitted to drain as freely as possible.

The air vent will further function to expel sewer gases to ambient and release any back pressures on the toilet so that it does not gurgle when drained and waste products do not back up, particularly into lower floor toilets when upper floor toilets are flushed. It should be understood that this invention is equally applicable to other types of toilet constructions, such as wall-mounted toilets wherein the soil pipe would be connected to a backside of the toilet rather than to the bottom side thereof, as shown in floor-mounted toilet 11 of FIG. 1.

Referring to FIG. 2, fresh-air breathing device 10 comprises a breathing means 16, shown in the form of a "soft" elastomeric (rubber or plastic) snorkel-type mouthpiece 17 having a teeth-engaging bite ring 18 formed integrally therewith. As shown in FIG. 1, the user is thus enabled to bite-down onto the mouthpiece to hold it in sealed communication with one of his respiratory intake passages (mouth). The breathing device further comprises a conduit means 19 for communicating fresh air from air vent 15 to the respiratory intake of the user.

The conduit means or tube comprises a first end 20 connected to breathing means 16 and an open second end 21 having sufficient flexibility and length for insertion through water trap 14 and exposure to fresh air vent 15. First end 20 can comprises a rubber-based or plastic material formed in its illustrated bellows-type configuration, whereas second end 21 can be composed of a standard plastic tube material. A suitable bonding adhesive is utilized to secure mouthpiece 17 and second end 21 to first end 20 of the conduit means.

As shown in FIGS. 3 and 4, a filtering means 22 can be secured within the air passage defined throughout breathing device 10 to adsorb any noxious or toxic impurities which may be contained in the air inhaled by the user. For example, residual sewer gases might be present in sewer line 13 and intermixed with the fresh air emanating from air vent 15 when the device is being used for breathing purposes. The filtering means is shown in canister form to contain charcoal 23 and screens 24 for retaining the charcoal in the canister. The canister can be press-fitted and/or adhesively secured within second end 20 of the device or at any other desired location within the air passage defined through this device. For example, the canister could be formed with nipples (not shown) on each end thereof for securance between the first and second ends of the device in a similar manner by which a PCV (positive crankcase ventilation) valve is attached between hoses in an automotive engine.

It should be further understood that breathing means 16 could take other forms, such as a mask-type breathing member similar to that employed on commercial aircraft for oxygen-breathing purposes, covering the nose and mouth of the user. In the latter application, as hereinafter discussed in reference to FIG. 5, it would further be feasible to connect a one-way check valve on the side of the mask whereby exhaling could occur through the check valve and the check valve would remain closed during the inhaling of fresh air through the device.

In carrying forth the method of this invention, it is assumed that the illustrated user is subject to toxic smoke inhalation as a result of fire or the like. The user would normally flush the toilet to expel substantially all sewer gases from an open area or chamber 25 of the toilet that is in open communication with air vent 15. Such flushing will also automatically create a suction effect in sewer line 13 to draw fresh air into chamber 25 via the fresh-air vent. Water trap 14 will automatically be formed, as is well known.

The user will then insert the second end of the breathing device into the water trap and place a hand thereunder to bend it past flanges 26 and 27 of the water trap and through the water forming the trap to expose the open end of the device to chamber 25. Once the level of the water trap is cleared and the open end of the device is positioned in chamber 25 to communicate with fresh air, the user can place his mouth on mouthpiece 17 and blow out any small amount of water which may have collected in the device upon insertion thereof through the water trap.

The user can then start inhaling fresh air and oxygen through the device and exhale through his nose. The user can maintain this breathing procedure for hours and until he is rescued. A fireman who has depleted his bottled supply of oxygen can follow the same method to breathe fresh air. Even though the user may breathe-in a small amount of sewer gas, it is obvious that this small inconvenience is insignificant in comparison to the saving of the user's life.

As suggested above and as shown in FIG. 5 snorkel-type mouthpiece 17 could be replaced with a face-mask type of breathing member 28 which covers both the mouth and the nose of the user's respiratory intake passages. In addition, and as mentioned above, a check valve 29 could be mounted in the face-mask so that the user can keep the face-mask constantly in sealed contact on his face, both during exhaling and inhaling.

I claim:

1. A method for breathing fresh air in a room filled with toxic smoke comprising the steps of inserting a breathing tube through a water trap of a toilet to expose an open end thereof to fresh air from a vent pipe connected to a sewer line of said toilet, and breathing said fresh air through said breathing tube.

2. The method of claim 1 further comprising the step of flushing said toilet prior to said inserting step.

3. The method of claim 1 further comprising the step of blowing any water out of said tube subsequent to said inserting step and prior to said breathing step.

4. The method of claim 1 further comprising the step of filtering the fresh air breathed through said tube.

* * * * *